US005754995A

United States Patent [19]

Behrendt

[11] Patent Number: 5,754,995

[45] Date of Patent: May 26, 1998

[54] MODULAR TRANSFORMABLE FURNITURE

[76] Inventor: Roger Behrendt, 1159 Wild Canary La., Olivenhain, Calif. 92024

[21] Appl. No.: 734,950

[22] Filed: Oct. 23, 1996

Related U.S. Application Data

[60] Provisional application No. 60/005,827 Oct. 24, 1995.

[51] Int. Cl.[6] ..... A47C 19/00

[52] U.S. Cl. ..... 5/201; 5/9.1; 5/296; 312/240

[58] Field of Search ..... 5/201, 200.1, 9.1, 5/8, 288, 296, 299; 52/645; 312/257.1, 265.4, 265.1, 108, 195, 240

[56] References Cited

U.S. PATENT DOCUMENTS

| | | | |
|---|---|---|---|
| 1,374,531 | 4/1921 | Smith | 5/9.1 X |
| 1,766,077 | 6/1930 | Jensen | 312/240 X |
| 3,154,797 | 11/1964 | Lovette | 5/296 |
| 4,126,906 | 11/1978 | Foust | 5/201 X |
| 4,340,984 | 7/1982 | Marcyan | 5/296 |
| 4,622,705 | 11/1986 | Joubert | 5/296 X |
| 4,651,362 | 3/1987 | Alperin et al. | 5/201 X |
| 5,014,861 | 5/1991 | Städler . | |
| 5,295,275 | 3/1994 | Sherman . | |
| 5,423,597 | 6/1995 | Rogers . | |
| 5,522,101 | 6/1996 | Yeh | 5/9.1 |

FOREIGN PATENT DOCUMENTS

| | | | |
|---|---|---|---|
| 128530 | 11/1946 | Australia | 5/200.1 |
| 206140 | 11/1959 | Austria | 5/9.1 |
| 465793 | 4/1914 | France | 5/9.1 |
| 497242 | 11/1919 | France | 5/9.1 |
| 1094893 | 5/1955 | France | 5/8 |
| 2505637 | 11/1982 | France | 312/240 |
| 2525706 | 10/1983 | France | 312/265.4 |
| 3242148 | 8/1984 | Germany | 312/240 |

*Primary Examiner*—James R. Brittain
*Assistant Examiner*—Hanh V. Tran
*Attorney, Agent, or Firm*—Fitch, Even, Tabin & Flannery

[57] ABSTRACT

A system of modular transformable furniture that utilizes a combination of basic structural assemblies that easily transform into over one hundred different items of furniture is provided. The combination of structural assemblies used in the construction of any individual furniture item includes at least two frame assemblies, one or more connecting assemblies, various optional accessory assemblies and a mechanism for interconnecting the frame assemblies, connecting assemblies, and accessory assemblies. The combination of assemblies can be joined and rejoined in a multitude of configurations to form a variety of aesthetically pleasing and useful furniture items including such items as: a bassinet; rocking cradle; changing table; play pen; crib; single, double, queen and king sized beds assemblies; double, triple and quadruple bunk bed assemblies; bed headboard and foot-board storage compartment units; dressers; storage cabinets; desks and computer desks; entertainment units; stereo cabinet; futon couch and bed; bench seat and toy box; night stand; vanity; kitchen work station; display shelving unit; and various table configurations.

10 Claims, 17 Drawing Sheets

MODULAR TRANSFORMABLE FURNITURE

This patent document is a non-Provisional patent application, which claims priority to Provisional patent application Ser. No. 60/005,827, filed on Oct. 24, 1995.

A portion of the disclosure of this patent document contains material that is subject to copyright protection. The copyright owner has no objection to the facsimile reproduction by anyone of this patent document or the patent disclosure, as it appears in the United States Patent and Trademark Office patent files or records, but otherwise reserves all copyright rights whatsoever.

BACKGROUND OF THE INVENTION

The present invention relates to modular ready to assemble, transformable furniture, and more particularly to such furniture wherein major components thereof are useable and reusable in assembling a multiplicity of furniture assemblies or items.

Fixed single or dual-purpose furniture assemblies are known in the art. Most furniture assemblies are single-purpose. Some single-purpose furniture assemblies are transformable within the context of the particular piece of furniture such as an entertainment unit with adjustable shelves and cabinet configurations. Other known furniture assemblies are dual purpose. Such dual-purpose furniture assemblies include, for example, sofa beds and futon couches, which serve as seating devices and are transformable into beds.

Virtually all of the furniture in a typical home or business is single-purpose, and a few pieces of furniture is such typical home or business are dual-purpose. Chairs and couches are used to sit on; beds to sleep, rest or otherwise recline; tables for work surfaces, or eating or meeting space; cabinets, shelves and drawers for storage or display.

Single-purpose furniture assemblies, and even some dual-purpose furniture assemblies, are not designed to be transformed into a multitude of separate, distinct furniture items. As a result, there is generally no utility to single or dual-purpose furniture assemblies beyond the singular or dual purpose for which they are designed. Typical household and office furniture items are not made to be disassembled and reassembled in numerous different configurations. Similarly, the individual components of typical household and office furniture items are not designed to be reutilized in an entirely different fashion.

Single-purpose and/or dual purpose furniture is typically very expensive because there are no economies gained by the consumer in applying their single-purpose or dual-purpose furniture expenditure in a way that yields additional furnishing utility. The useful life of single-purpose or dual-purpose furniture is limited by the utility of the particular furniture assembly. Baby furniture is an excellent example. Cradles, bassinets, changing tables, cribs and the like all typically outlive their utility to any particular user. Thus, single and even dual-purpose furniture items are typically stored, sold or discarded once their useful life for a particular user is over. The environmental expense and impact is considerable with regard to the increased consumption of wood and other natural resources, and land fill area consumed for disposal of discarded single and dual-purpose furniture.

When a piece of furniture is no longer of use, it is often stored, sold or discarded. Most of the stored furniture clutters storage areas such as attics, basements, garages, closets or rented off-site storage units. Most single and dual-purpose furniture is not easily disassembled for storage, consuming a large amount of expensive and scarce storage space.

Single or dual-purpose furniture that is not sold as "ready to assemble" is sold as "case goods" meaning that it is transported from place to place in its most voluminous configuration, often shipped in a crate or case. "Case goods" furniture consumes a large volume in the factory, the warehouse, the shipping channel, i.e., in trucks, railroad cars, ships and the like, and ultimately with the consumer.

SUMMARY OF THE INVENTION

The present invention is modular transformable furniture for use in the construction and transformation of numerous different furniture items. A preferred embodiment of the modular transformable furniture utilizes a combination of simple structural assemblies that easily transform into over one hundred different items of furniture. The combination of structural assemblies used in the construction of any furniture item includes at least two frame assemblies, one or more connecting assemblies and a means for interconnecting the frame assemblies with the connecting assemblies. Optionally, a variety of accessory assemblies can be further interconnected with the frame assemblies and connecting assemblies in a manner that provides aesthetically pleasing and useful furniture items for a home or office environment.

The present invention can also be characterized as a modular transformable furniture system that includes a plurality of components that are joined and rejoined in a multitude of configurations to form individual pieces of furniture. The furniture items that can be formed with the modular transformable furniture system include, but are not limited to: a bassinet; rocking cradle; changing table; play pen; crib; single, double, queen and king sized beds assemblies; double, triple and quadruple bunk bed assemblies; bed headboard and foot-board storage compartment units; dressers; storage cabinets; desks and computer desks; entertainment units; stereo cabinet; futon couch and bed; bench seat and toy box; night stand; vanity; kitchen work station; display shelving unit; and various table configurations.

BRIEF DESCRIPTION OF THE DRAWINGS

The above and other aspects of the present invention will be more apparent from the following more particular description thereof, presented in conjunction with the following drawings wherein.

Corresponding reference characters indicate corresponding components throughout the several views of the drawings.

DETAILED DESCRIPTION OF THE PREFERRED EMBODIMENTS

Figure 1:
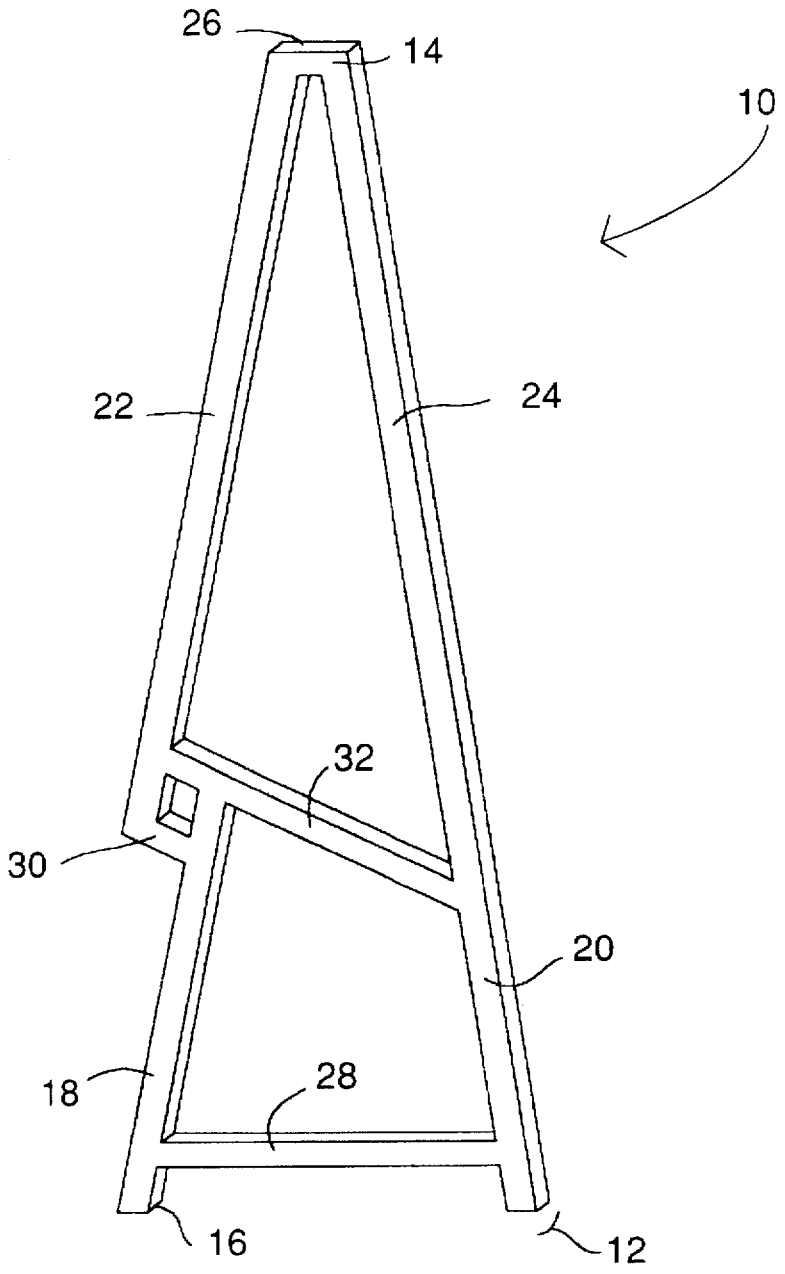
FIG. 1 is perspective view of the A-frame assembly of the present invention.

The following description is of the best mode presently contemplated for carrying out the invention. This description is not to be taken in a limiting sense, but is made merely for the purpose of describing the general principles of the invention. The scope of the invention should be determined with reference to the claims.

The modular, ready to assemble, transformable furniture system comprises components that are joined and rejoined in a multitude of configurations to form pieces of household, hospitality industry, retail display and office furniture. The components include multipurpose frame assemblies and interchangeable connecting assemblies and accessory assemblies. Associated with each of the assemblies are various joining or interconnection mechanisms such that the selected assemblies are readily disjoined and rejoined to produce different pieces of furniture. As indicated above, the individual pieces of furniture are common household and office furniture items including, but not limited to: bassinet; rocking cradle; changing table; play pen; crib, day bed; single, double, queen and king sized beds assemblies; double, triple and quadruple bunk bed assemblies; bed headboard and foot-board storage compartment units; dressers; storage cabinets; desks and computer desks; entertainment units; futon couch and bed; bench seat and toy box, clothes hamper; end table and bed side night table; pedestal desk; stand at desk and drafting table; vanity; kitchen work station; and display shelving.

The modular, transformable and ready to assemble furniture system is designed to serve many different furniture needs. When a particular furniture item is no longer needed, the components are readily disjoined. More importantly, each individual component can be reutilized in the construction of an alternative furniture piece. For example, a group of individual assemblies or components can be joined to form a cradle. When the cradle is no longer needed, it is disassembled and some or all of the individual components are reused in an entirely different piece of furniture. The individual components of the cradle are rejoined in a different configuration to form, for example, such furniture items as a single bed, storage chest, shelving units, desk units, and entertainment centers. Since the individual components can be used and reused in the construction of various furniture items, the utilitarian life of the components is extended and the owner receives the enjoyment of having additional functional and aesthetically pleasing furnishings with little or no additional cost. Moreover, the unique design and rugged construction of the modular transformable furniture are features that can be appreciated and valued in perpetuity.

The modular transformable furniture is comprised of a combination of a plurality of frame assemblies, one or more connecting assemblies, optional accessory assemblies, and a means for interconnecting the assemblies together. The various assemblies are attached or joined to one another using simple interconnection hardware. The interconnection hardware enables easy initial assembly, disassembly and alternate furniture transformation. The simple interconnection hardware also enables easy disassembly for storage. All of the individual assemblies can be stored or transported in a manner that minimizes the volume of space consumed. Each of the constituent elements of the modular transformable furniture and furniture system are discussed in more detail in the paragraphs that follow.

FRAME ASSEMBLIES

Turning now to the drawings, and in particular to FIG. 1, there is illustrated an embodiment of the A-15 frame assembly 10. The A-frame assembly is one of the fundamental cornerstone building blocks used in the modular transformable furniture system and is used in many of the individual furniture items. The A-frame assembly 10 is generally triangular in shape and is preferably oriented such that it sets perpendicular to the ground plane 12. The preferred embodiment of the A-frame 10 is approximately seventy six inches in height, as measured from the apex 14 of the triangular shaped assembly to the base of the frame assembly in a direction perpendicular to the ground plane 12. This dimension, as well as all dimensions of the A-frame assembly 10, can be easily modified or scaled down without sacrificing the advantages and features offered by the modular, transformable furniture.

The illustrated embodiment of the A-frame assembly 10 also includes a pair of lower vertices, 18 and 20, that are separated at the ground plane 12 by a distance of approximately thirty inches and a pair of upper vertices, 22 and 24. The upper vertices or legs that intersect the apex 14, are separated at the apex of the frame assembly by a distance of approximately six inches. Connecting the two upper vertices together is an upper horizontal cross member 26. Connecting the two lower vertices together is a lower horizontal cross member 28. The upper horizontal cross member is located at or near the apex of the frame assembly while the lower horizontal cross member is located near the base of the A-frame assembly. The approximate height of the upper horizontal cross member is seventy six inches, while the lower horizontal cross member maximum height is approximately six and one half inches off of the ground plane.

As seen in FIG. 1, the vertices, 18, and 22, on one side of the generally triangular shaped A-frame assembly 10 are disposed in a parallel orientation to one another and are offset or separated from each other by a distance of approximately four to six inches. The vertices, 20 and 24, on the other side of the generally triangular shaped frame assembly 10 are disposed in an aligned orientation forming a straight leg running from the ground plane 12 to the apex 14. The plurality of vertices are further intersected by one short and one long diagonal cross members, 30 and 32. The short diagonal cross member 30 connects the upper vertice 22 and lower vertice 18 on the offset side of the generally triangular shaped A-frame assembly. The long diagonal cross member 32 connects the upper and lower vertices, 18 and 22, on the offset side of the generally triangular shaped A-frame assembly with the upper and lower vertices 18, and 22, on the aligned side of the generally triangular shaped A-frame assembly. The diagonal cross members add to the structural integrity of the A-frame assembly and also provide a unique design characteristic to the modular transformable furniture.

The particular configuration of the illustrated A-frame assembly 10 offers several advantages to the furnisher. First, the parallel vertices, 18 and 22, are offset from one another so that the offset side of the A-frame assembly can stand closer to a wall which represents a better utilization of space. As seen in FIG. 1, the maximum width of the A-frame assembly is found at the base 16 of the frame assembly. As in many A-frame structures, the vertices, 18, 20, 22 and 24 do not extend outside the base of the frame assembly. However, at the offset location in the present A-frame assembly, the upper vertice 22 extends to a position that is vertically aligned with the base of the assembly. Both the base of the A-frame assembly and the offset portion of the A-frame assembly can be placed close to a wall or other surface which is advantageous from an aesthetic point of view as well as from a utilitarian point of view. Second, the offset nature of the A-frame assembly provides a greater useable area within the confines of the A-frame assembly. In other words, the width of the A-frame assembly, as measured horizontally from one side of the A-frame assembly to the other side at the intermediate or offset location, is only slightly less than the maximum width, which from a structural standpoint, is located at the base of the A-frame assembly. This increased width at the intermediate or offset location provides easier access to items on the frame itself, i.e. shelves.

Figure 4:
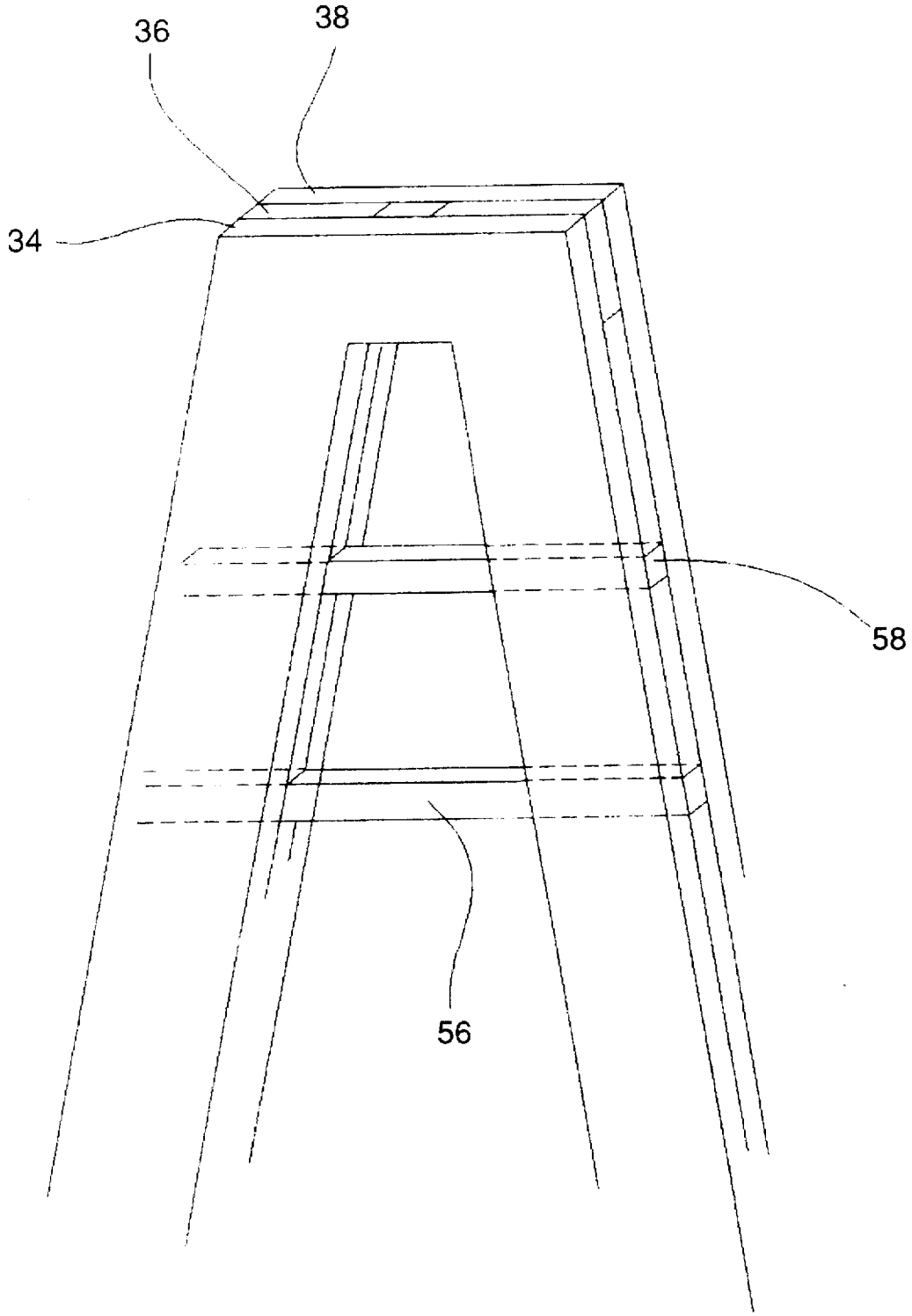
FIG. 4 is an illustration of the knock out plugs associated with various frame assemblies in accordance with the present invention.

The A-frame assembly 10 is preferably constructed of three layers of material affixed to each other with glue or other adhesive (FIG. 4). The A-frame assembly is constructed on a flat pattern or mold (not shown). The first layer 34 of material is placed without glue on the flat pattern. The second and third layers, 36 and 38, of material are overlaid on top of the previous layer with glue applied between the layers to promote adhesion. The width of the materials used is approximately two and one quarter inches by three quarter inches. When three layers of this material are stacked, glued and clamped in the pattern or mold, the collective depth is two and one quarter inches. Thus, the cross section of the frame assembly is approximately two and one quarter inches square. At the various intersection junctions of the cross members, 30 and 32, and vertices, 18, 20, 22 and 24, care is exercised during the A-frame assembly construction to alternately overlap the respective layers of the cross members and vertices. This overlapping construction technique provides increased flat surface area between the joined components at the intersection joints. When glued together, the increased flat surface area produces relatively strong joints which maximizes the structural stability of the frame assembly.

Advantageously, the A-frame assembly 10 is not prone to tipping or being knocked over by natural forces (i.e. earthquakes) or from inadvertent forces resulting from accidents, childs play, and the like. The improved stability is attributable to the wide base foot print of the frame assembly relative to the upper more narrow area. Conventional shelving or other typically tall entertainment or wall units tend to be narrowly based and are more prone to movement in volatile situations such as an earthquake.

As indicated above, the specific dimensions, size, shape and general construction of the A-frame assembly 10 (as well as the other assemblies described herein) can be tailored to suit the applications and general decor in which they are used. For example, the particular assemblies may be molded plastics or formed metal structures of various colors. The size of the assemblies can be adapted for small scale models, for child size furniture, standard size furniture, or even over-sized structures without sacrificing all of the disclosed features and advantages.

Figure 2:
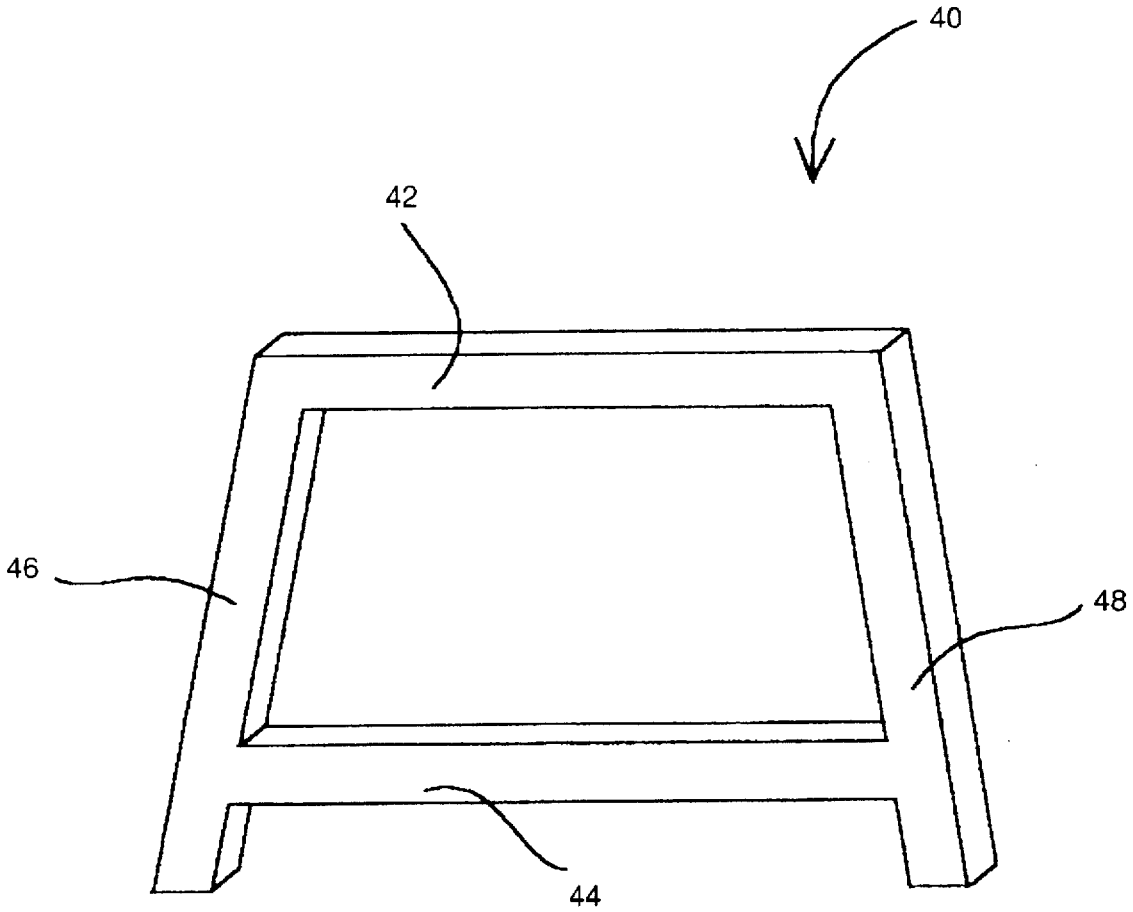
FIG. 2 is a perspective view of a trapezoidal frame assembly (T-Frame) of the present invention.

Referring next to FIG. 2, there is shown an embodiment of the trapezoidal frame assembly 40. The trapezoidal frame assembly 10 is another cornerstone component of the modular transformable furniture system and is also one of the fundamental building blocks used in the construction of the transformable furniture items configurations. The trapezoidal frame assembly includes a pair of parallel cross members, 42 and 44, connecting a pair of angled vertices.

As with the A-frame assembly 10, the trapezoidal frame assembly 40 is preferably constructed of multiple layers of a material, such as wood or particle board, that are rigidly affixed to each other. Each layer includes one or more pieces that collectively conform to the general shape of the trapezoidal frame assembly. The first layer of material is placed on an appropriate pattern or mold. The remaining layers of material, each conforming to the general shape of the trapezoidal frame assembly, are overlaid on top of the previous layer and rigidly secured thereto. The preferred method of adhesion is by applying a sufficient quantity of glue or other adhesive between successive layers. As with the A-frame assembly, the preferred depth and width of each member in the multi-layered trapezoidal frame assembly is two and one quarter inches. Thus, the cross section of any member of the trapezoidal frame assembly is preferably two and one quarter inches square. These dimensions were chosen because, as is well known in the woodworking art, many stock items and materials come in a thickness of 0.75 inches (three-quarters of an inch). Thus, utilizing only standard sized stock, one can couple three, three-quarters of an inch thick boards together resulting in a two and one quarter inch thick frame assembly. However, the actual dimensions of the entire trapezoidal frame assembly can vary depending on the particular furniture item in which it is used and the material used in constructing the same. The preferred modular transformable furniture system contemplates the use of several different sized trapezoidal frame assemblies each having a preset dimension.

Figure 3:
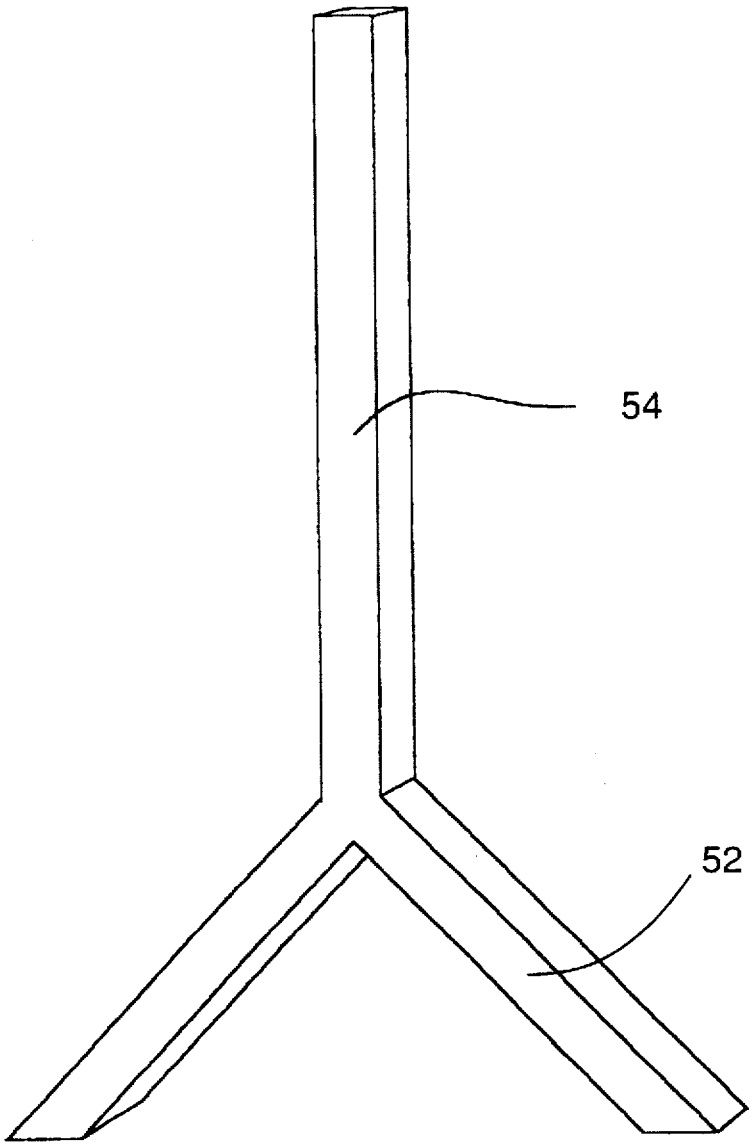
FIG. 3 is a perspective view of a pedestal frame assembly of the present invention.

Turning next to FIG. 3, the illustrated embodiment of the pedestal frame assembly 50 provides an alternate cornerstone component of the preferred modular transformable furniture system. As with the other frame assemblies, the pedestal frame assembly is also one of the fundamental building blocks used in some of the modular furniture items.

The pedestal frame assembly 50 is the simplest of the frame assemblies and is comprised of a base unit 52 and a stem 54. In the illustrated embodiment, the base unit is adapted to be set on the floor or ground and is formed in the shape of a standing arch. The width of the standing arch is of sufficient dimension to provide stability to the constructed furniture item. The stem extends from the top of the standing arch and in a direction perpendicular to the plane of the ground. The stem preferably includes an integral coupling means that is adapted to interconnect the pedestal frame assembly with various connecting and accessory assemblies, as more fully described below.

INTERCONNECTION ELEMENTS

Figure 5:
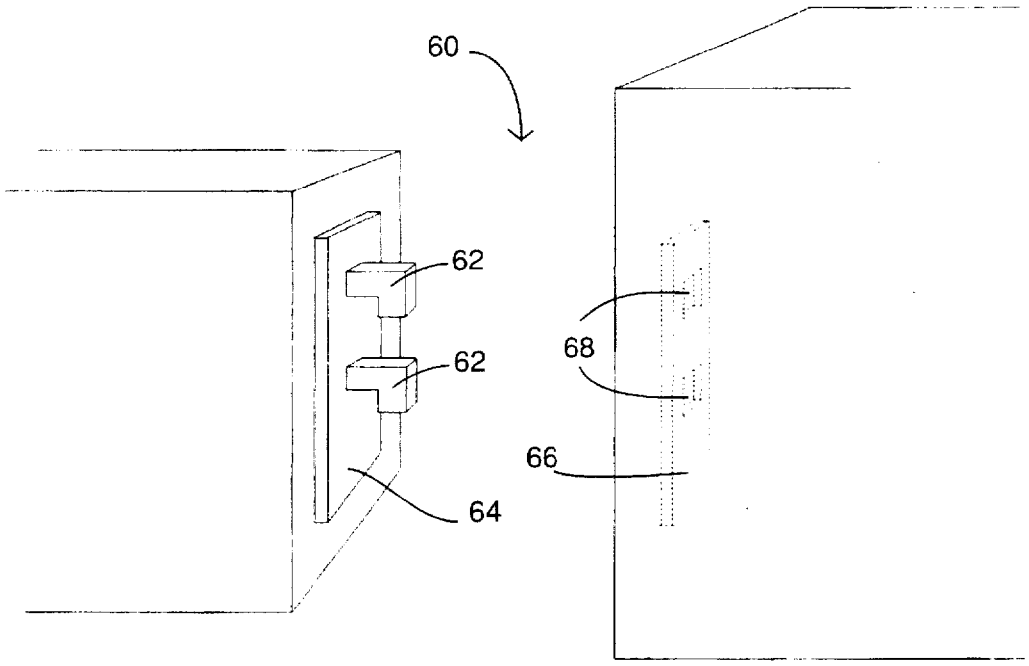
FIG. 5 is an illustration of an interconnecting mechanism comprising an engaging structure and corresponding support member in accordance with the present invention.
Figure 6:
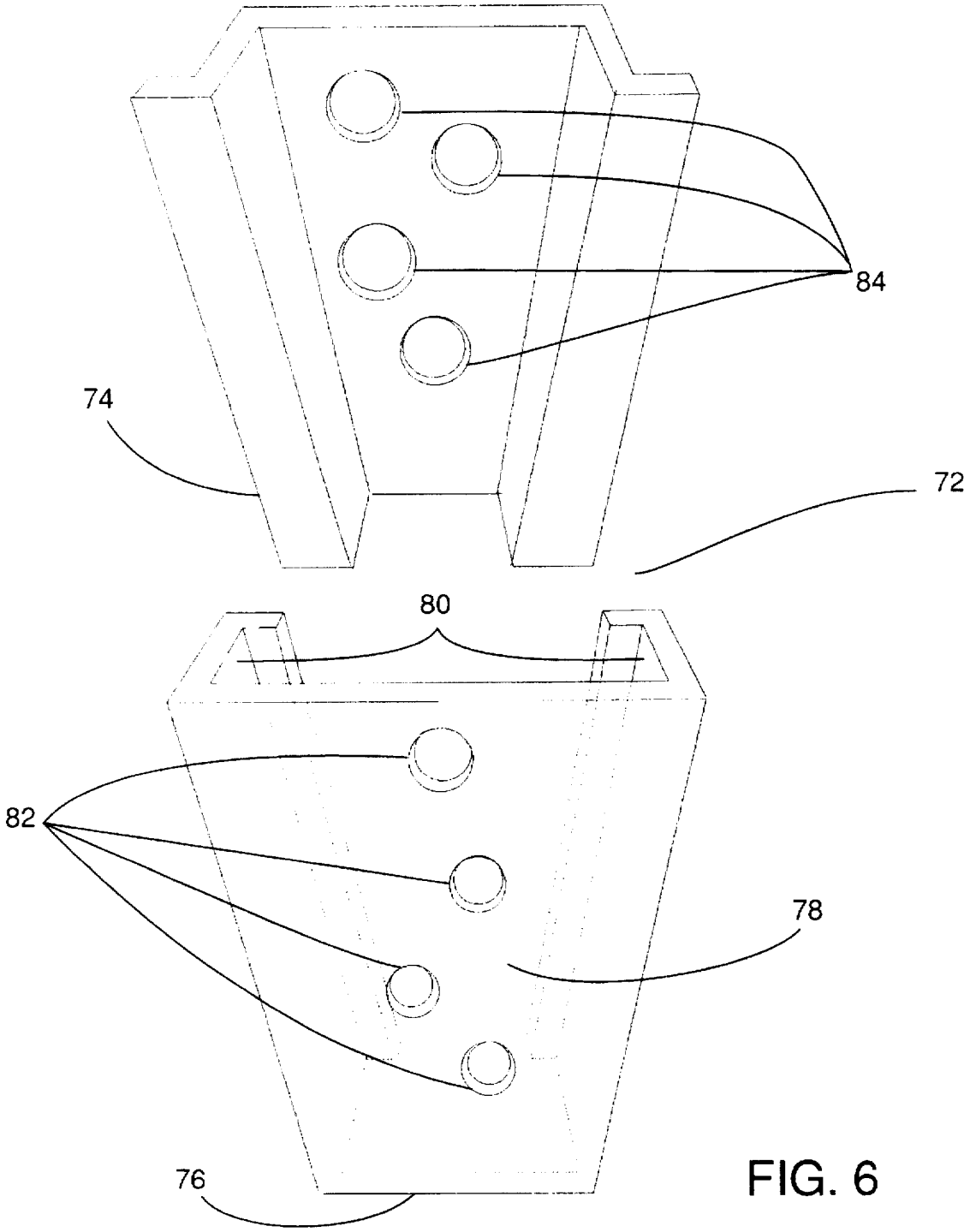
FIG. 6 is an illustration of an alternative interconnecting mechanism including the V-wedge assembly in accordance with the present invention.

In order to connect the frame assemblies with the connecting assemblies as well as with various accessory assemblies, the modular transformable furniture includes various interconnection mechanisms. Although many different interconnection mechanisms exist for connecting components for a given piece of furniture, the preferred interconnection mechanisms are those mechanisms that are structurally integrated with the various assemblies such that they are, easy to use, aesthetically pleasing, and structurally sound. Several examples of structurally integrated interconnecting mechanisms are illustrated in FIGS. 4–6.

As seen in FIG. 4, the frame assemblies include several knock out plugs 56. The solid material knock out plugs are located in the intermediate layers (or other central location) of the multi-layered frame assemblies and are adapted to be easily removed and reinserted. When removed, the knock out plugs expose corresponding cavities 58 that are located in the second layer 36 of the frame assembly and sandwiched between the outer layers (first and third layers), 34 and 38. The knock out plugs preferably pass through the frame assemblies on a horizontal axis. Further, the preferred knock out plug and corresponding cavity have a generally square cross section and a length that is approximately the same as the width of the cross members or vertices of the frame assembly (i.e. 2.25 inches), as measured in a direction horizontal to the ground plane 12. The cavity or void left when the knock out plug is removed is adapted to accommodate similarly dimensioned extensions disposed on accessory and connecting assemblies.

Alternatively or conjunctively, the frame assemblies have one or more support members that are adapted to provide a surface for gravitational rest and attachment of engaging structure disposed on various connecting and accessory assemblies. An embodiment of the support members and corresponding engaging structure is illustrated in FIG. 5. As seen therein, the engagement structure includes a flat plate secured to an end of a connecting assembly. The engagement structure further includes two L-shaped protrusions 62 extending from the flat plate 64. The support member includes a flat receiving plate secured to a surface of the frame assembly. The flat receiving plate 66 also includes a pair of holes 68 adapted to receive the L-shaped protrusions. A small receiving cavity 70 is located immediately behind the flat receiving plate 66 such that the protrusions 62 of the engaging structure can be inserted therein leaving a minimum clearance between assemblies. The flat receiving plate 66 provides a surface upon which the engagement structure rests yet can be easily disengaged by an individual. Collectively, the support members and engagement structure 60 form an interconnection element or engagement device used to join the frame assemblies with various connecting and accessory assemblies.

A third alternative interconnection mechanism is the use of V-wedge sliding connectors. These connectors are preferably used where the connecting and accessory assemblies have a cross-sectional area that is too small to safely and reliably utilize the above described engagement device. An embodiment of the preferred V-wedge siding connectors are illustrated in FIG. 6. As seen therein, the V-wedge connector 72 includes a flat V-wedge element 74 and a corresponding receiving element 76. The receiving element is comprised of a flat main body section 78 having a generally tapered configuration. The edges of the flat main body section are contoured to form edge channels 80 suitable for slidably receiving the flat V-wedge element 76. The receiving element further includes a plurality of holes 82 in the flat main body section such that the receiving element can be screwed or otherwise attached to the frame assemblies. The V-wedge element also has a plurality of holes 84 therein such that the V-wedge element can be secured to the ends of the connecting and accessory assemblies.

CONNECTING AND ACCESSORY ASSEMBLIES

Each item of furniture also includes various connecting and accessory assemblies. As seen in FIGS. 7–17, the primary connecting assemblies include support beams 86, support planks 88, base cross rails 90, top cross rails 92, truss members 94, arch members 96, and rail members 98. The connecting items provide structural support for the furniture item in addition to connecting two frame assemblies together.

In particular, the support beams 86 are preferably two inch by six inch (2"×6") beams of prescribed lengths. Located at each end of the support beams are engagement structures of an interconnection element. Thus, the support beams are preferably attached to the frame assemblies using the interconnection elements comprised of the engagement structures 60 and corresponding support members 66 located on the frame assemblies.

The top cross rails 90 and base cross rails 92 are preferably two inch by two inch (2"×2") beams of varying lengths. Located at each end of the top cross rail and base cross rail are V-wedge elements 74 which are adapted to securely engage or interconnect with corresponding receiving elements 76 disposed at the appropriate locations on the frame assemblies.

Another common connecting assembly is a support plank 88. The support plank includes various flat surface boards that extend between frame assemblies. The length and width of the support planks are selected based on the size and type of furniture item being constructed. The interconnection mechanism utilized with the support planks can be either the V-wedge sliding connectors 72 or plank extensions which can be inserted into the voids 58 where knock out plugs 56 have been removed from the frame assembly.

Still other connecting assemblies include a family of decorative and structural elements, namely, the truss member 94, rail member 98 and arch member 96. Many different items of furniture have configurations that utilize one of these three members. In fact, these three members are typically interchangeable elements in the modular transformable furniture system. As with all connecting and accessory assemblies, the truss member, rail member 98 and arch member 96 are available in different sizes and different aesthetic designs. Located at each end of the truss member, rail member, and arch member are the interconnection mechanism. The preferred interconnection mechanism used to connect a frame assembly with a truss member or arch member is the engagement structure 60 and support member combination 66. The preferred interconnection mechanism used to connect the frame assembly with the rail member is the V-wedge element 74 which is adapted to securely engage and interconnect with a corresponding V-wedge receiving element 76 disposed at the appropriate location on the frame assemblies.

Some of the accessory assemblies comprising part of the modular transformable furniture include such items as safety rails, shelving units, drawer units, decorative inserts, interior slats, bunk ladders, head boards, foot boards, door units, bed hardware, swing hardware, cradle hardware, backing surfaces, flying vertical supports and/or flying horizontal supports, decorative table surfaces, light units, stained glass inserts, futon hardware, corner adapter sets, as well as many other specially designed assemblies.

FURNITURE ITEMS

Each item of furniture is designed and constructed using a common set of the aforementioned, ready to assemble components. Table 1 below lists a few of the different furniture configurations that can be constructed using the present modular transformable furniture system including the above-described, frame assemblies, connector assemblies and accessory assemblies, and interconnection means. The list identified in Table 1 is by no means exhaustive and it is contemplated that many other furniture items can be designed given the teaching and related examples provided herein.

the scope of the invention be determined by the subsequently presented claims and their equivalents.

Figure 7:
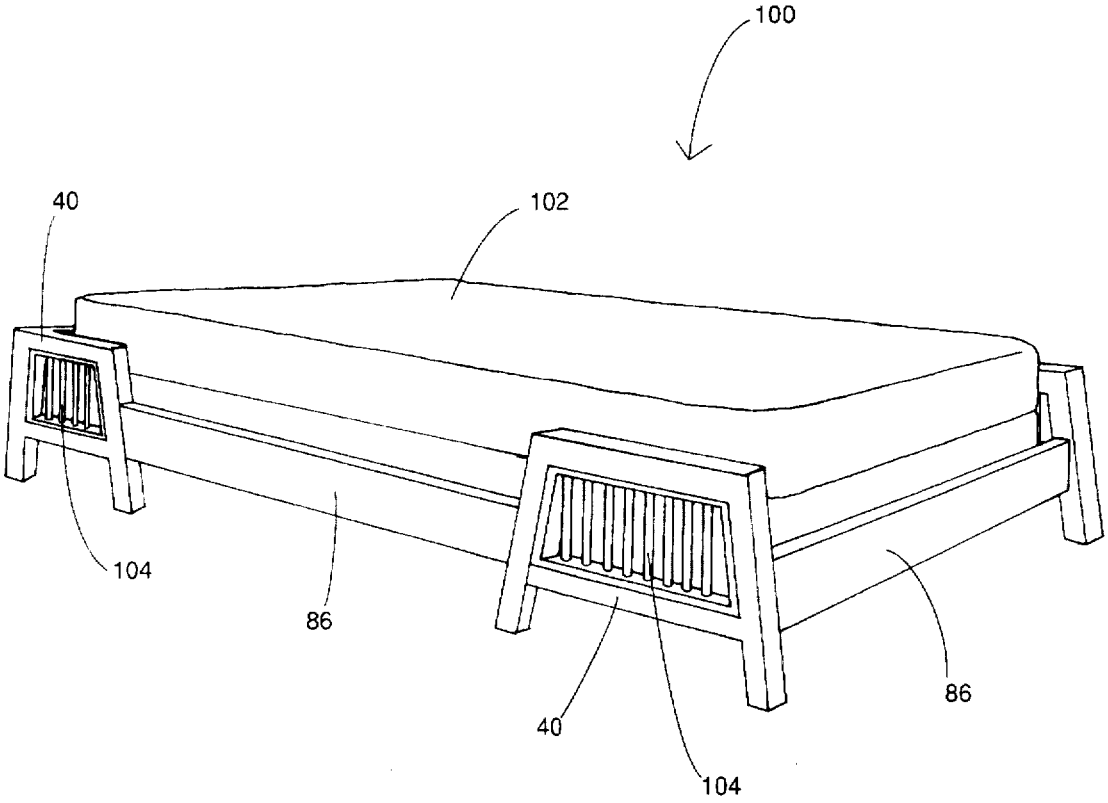
FIG. 7 is single bed constructed from a combination of frame assemblies, connecting assemblies and accessory assemblies in accordance with the present invention.

Turning now to FIG. 7, there is illustrated a single bed 100 that is constructed from four trapezoidal frame assemblies (T-Frames) 40 that are connected with four support beams 86. The support beams 86 are the connecting assemblies which are configured as support rails at the head, foot and sides of the bed. The bed also includes several accessory assemblies including mattresses 102 or other bed hardware, and interior slats 104 within each trapezoidal frame assembly.

Figure 8:
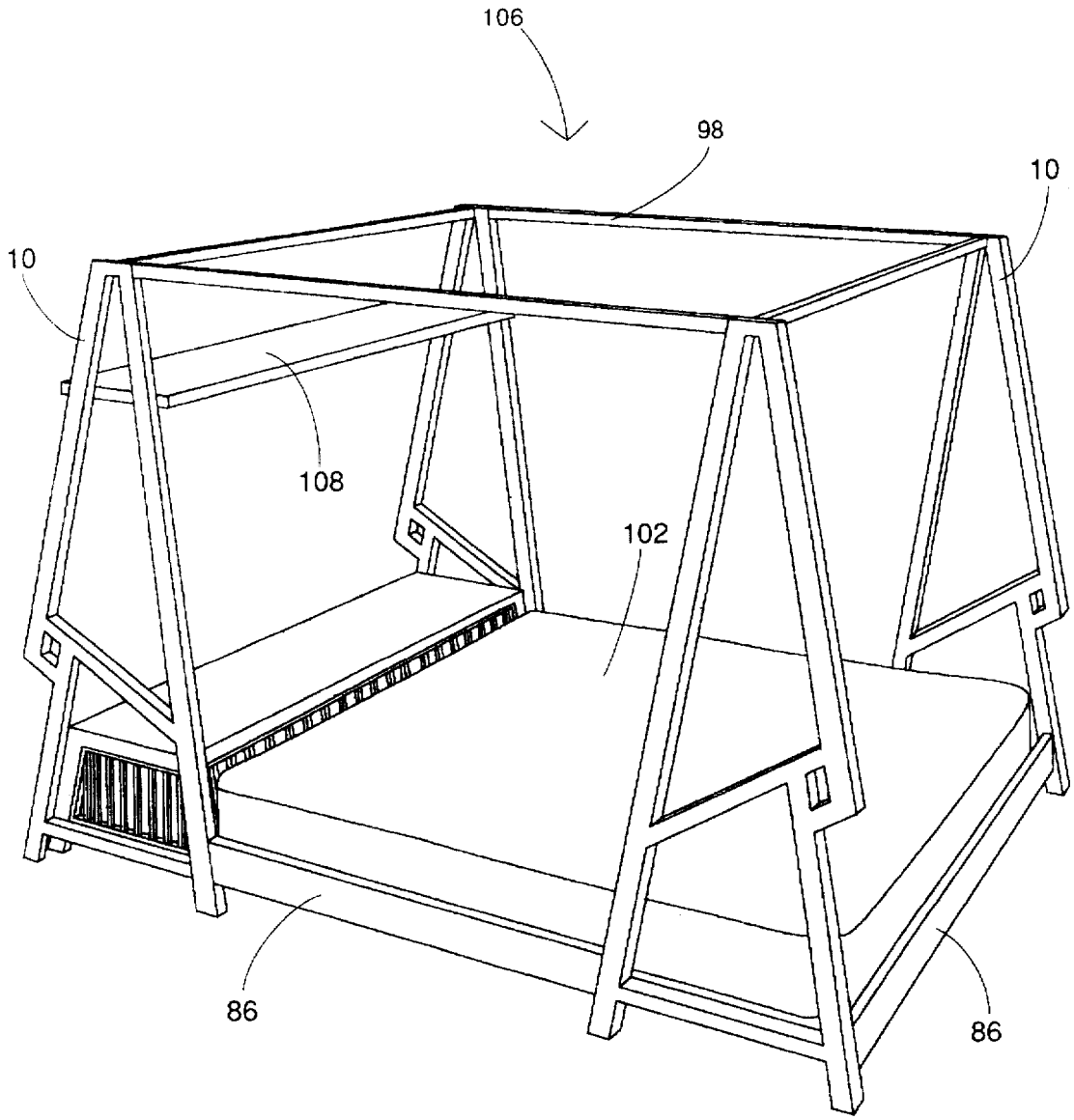
FIG. 8 is a queen size bed with a canopy constructed from a combination of frame assemblies, connecting assemblies and accessory assemblies in accordance with the present invention.

Referring next to FIG. 8 there is illustrated a queen bed 106 with canopy. This queen size bed is constructed from four A-Frame assemblies (A-Frames) 10 that are connected with support beams. As with the bed in FIG. 7, the support beams 86 are connecting assemblies which are configured as support rails at the head, foot and sides of the bed. The canopy portion of the bed is constructed with four rail members 98 that connect the A-Frame assemblies together. The bed also includes several accessory assemblies including shelving units 108 and other bed hardware.

TABLE 1

Furniture Item Configurations

| Furniture Item | Frame Assembly | Connecting Assembly | Accessory Assembly | Interconnection Means |
|---|---|---|---|---|
| Bed (Twin, Double, Queen, King) | A-Frame (2) T-Frame (2) | Support Beams (4) Arch, Rail, or Truss | Interior Slats Shelve Units Head Board Foot Board | Plugs & Inserts Engaging Device V-wedge |
| Bed (Twin, Double, Queen, King) | T-Frame (4) | Support Beams (4) | Interior Slats Head Board Foot Board | Plugs & Inserts Engaging Device V-wedge |
| Bed, Canopy (Twin, Double, Queen, King) | A-Frame (4) | Support Beams (4) Rail and/or Truss | Shelve Units Head Board Foot Board | Plugs & Inserts Engaging Device V-wedge |
| Bunk Bed | A-Frame (4) | Support Beams (8) Rails and/or Truss | Ladder Safety Rails | Plugs & Inserts Engaging Device V-wedge |
| Quad Bunk Bed | A-Frame (6) | Support Beams (14) Rails and/or Truss | Ladder Safety Rails | Plugs & Inserts Engaging Device V-wedge |
| Entertainment Unit | A-Frame (2) | Base Cross Rail Top Cross Rail Support Planks Vertical Cross | Shelve Units Unit Backing Drawer Units Door Units | Plugs & Inserts V-wedge |
| Desk | Pedestal (2) | Base Cross Rail Support Plank | Drawer Unit Interior Slats | Plugs & Inserts V-wedge |
| Desk | A-Frame (2) | Base Cross Rail Top Cross Rail | Shelve Units Drawer Units Desk Surface | Plugs & Inserts V-wedge |
| Cradle | A-Frame (2) T-Frame (2) Pedestal (2) | Support Beams (3) Base Cross Rail | Interior Slats Swing Hardware Cradle Surface Safety Rails | Plugs & Inserts Engaging Device V-wedge |
| Night Stand | T-Frame (2) | Top Table Surface Support Plank | Drawer Unit Interior Slats | Plugs & Inserts V-wedge |
| Toy Chest | T-Frame (2) | Support Plank | Hinged Lid Interior Slats | Plugs & Inserts V-wedge |
| Draft Table | A-Frame (2) | Base Cross Rail Top Cross Rail Vertical Cross | Table Surface | Plugs & Inserts V-wedge |
| Display Shelves | A-Frame (2) | Base Cross Rail Top Cross Rail Vertical Cross | Shelve Units | Plugs & Inserts V-wedge |

Figure 9:
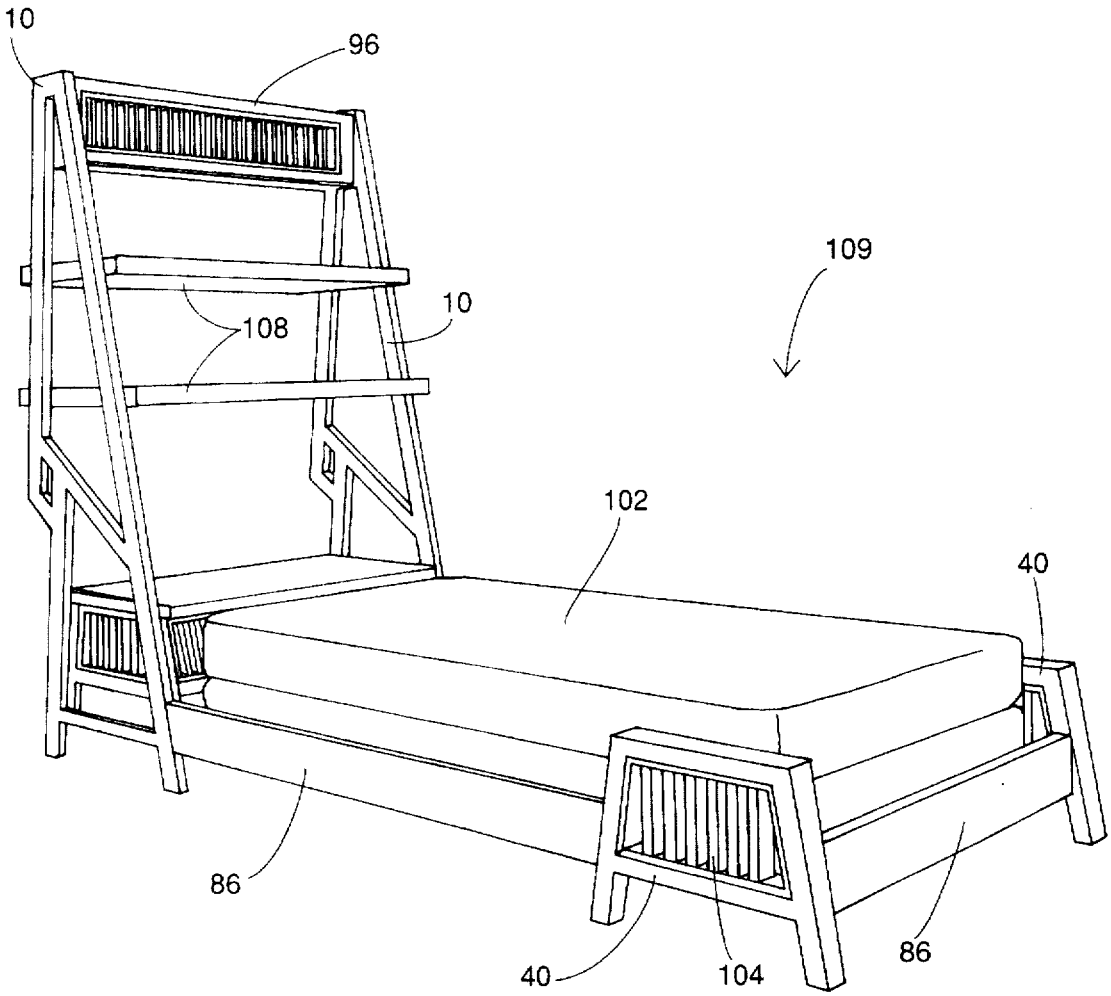
FIG. 9 is yet another configuration of a bed, together with a night stand and a storage chest, wherein each of the items are constructed from a combination of frame assemblies, connecting assemblies and accessory assemblies in accordance with the present invention.

The following are descriptive examples of the application of the modular transformable furniture system and the use of the various assemblies associated therewith. It is not intended that the scope of this invention be limited to these specific furniture items described. Rather, it is intended that Another bed configuration 109 is shown in FIG. 9. This particular configuration utilizes two A-Frame assemblies 10 and two trapezoidal frame assemblies 40 connected with four support beams 86. The illustrated bed further has an arch member 96 at the head of the bed connecting the two A-frame assemblies. Alternatively, truss members or rail members could be used in lieu of the arch member to connect the A-frame assemblies. The bed also includes several accessory assemblies such as shelving units 108 and interior slats 104 in each of the trapezoidal frame assemblies. FIG. 9 also illustrates several other furniture items including a night stand 110 and storage chest. The particular configuration for these furniture items is constructed using a pair of trapezoidal frame assemblies 40 together with various connecting assemblies, such as support planks. Drawer units 112, shelving units 108 and interior slats 104 or other decorative inserts are included as the accessory assemblies for these furniture items.

Figure 10:
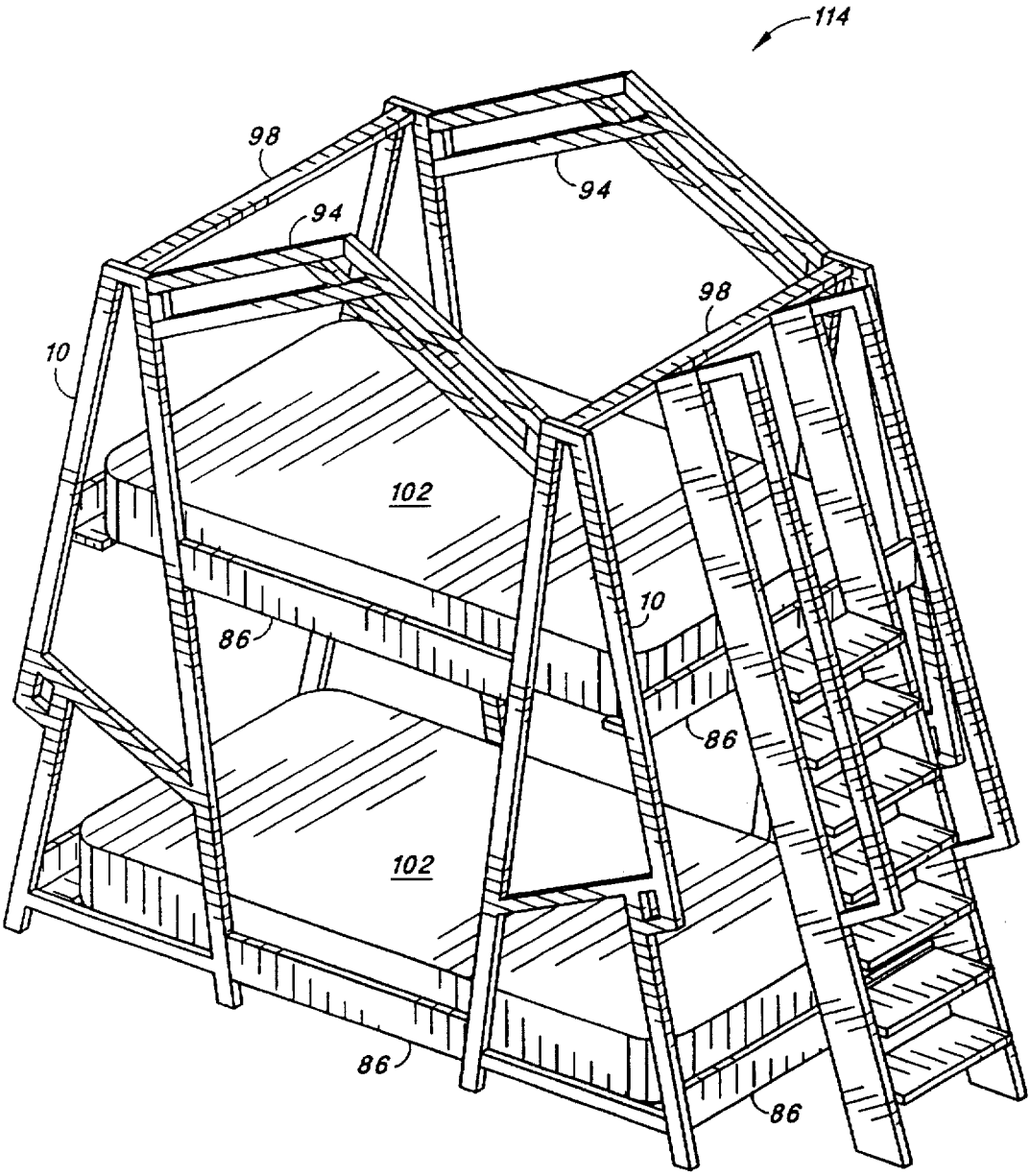
FIG. 10 is bunk bed with a canopy that is shown with a combination of frame assemblies, connecting assemblies and accessory assemblies in accordance with the present invention.

Referring next to FIG. 10 there is illustrated a bunk bed 114 with canopy. The bunk bed is assembled using four A-frame assemblies 10. Various connecting assemblies are shown including eight support beams 86, a pair of truss members 94 and a pair of rail members 98. FIG. 10 also illustrates the bunk ladder 116 which represents an accessory assembly.

Figure 11:
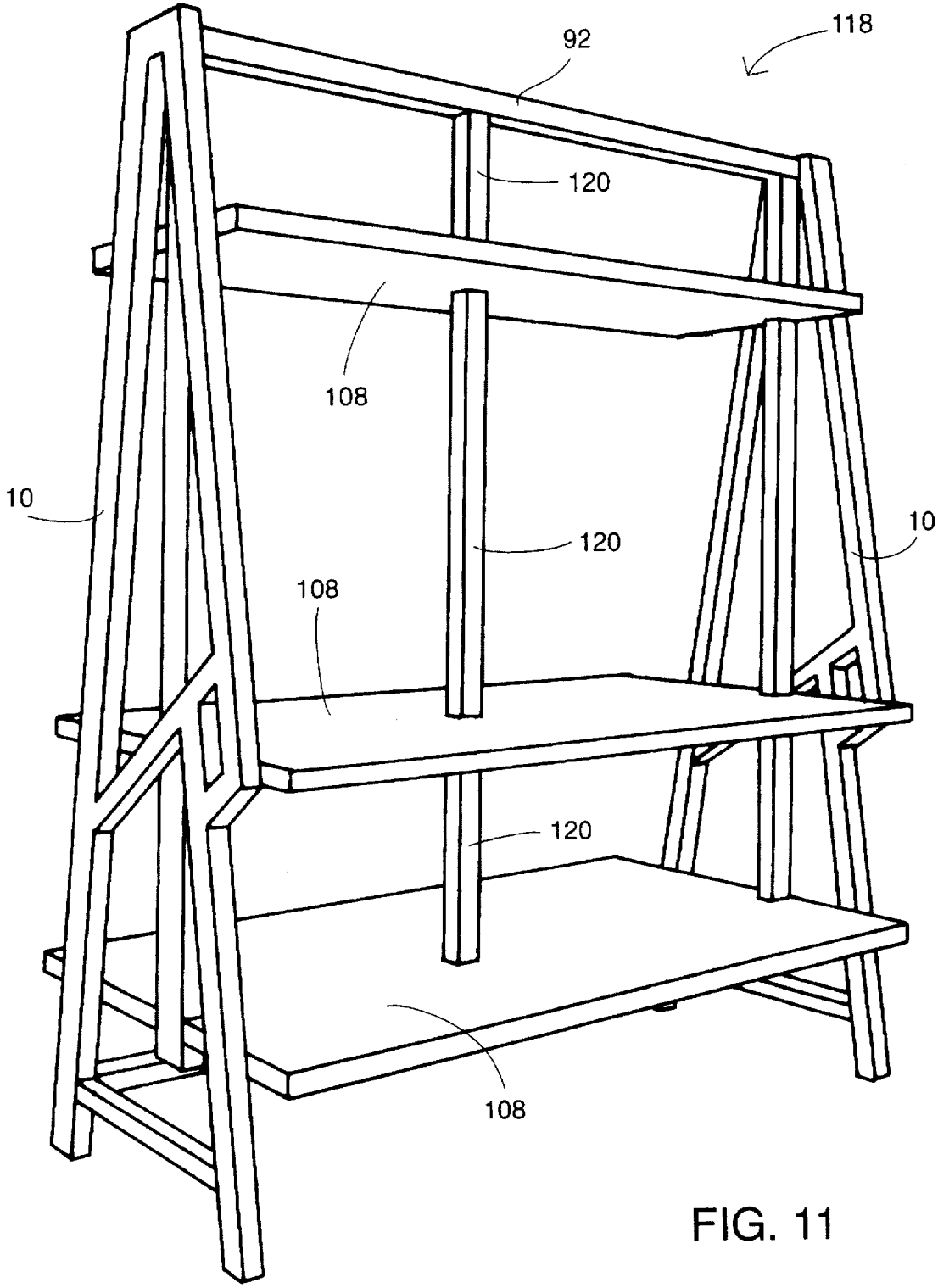
FIG. 11 is shelving unit constructed from a combination of frame assemblies, connecting assemblies, and accessory assemblies in accordance with the present invention.

FIG. 11 depicts a shelving unit 118 which is constructed with a pair of A-frame assemblies 10 connected together with a top cross rail 92 and a base cross rail 90. The shelving unit 118 includes three shelves and a plurality of vertical supports 120 which are also referred to as a vertical cross or flying cross.

Figure 12:
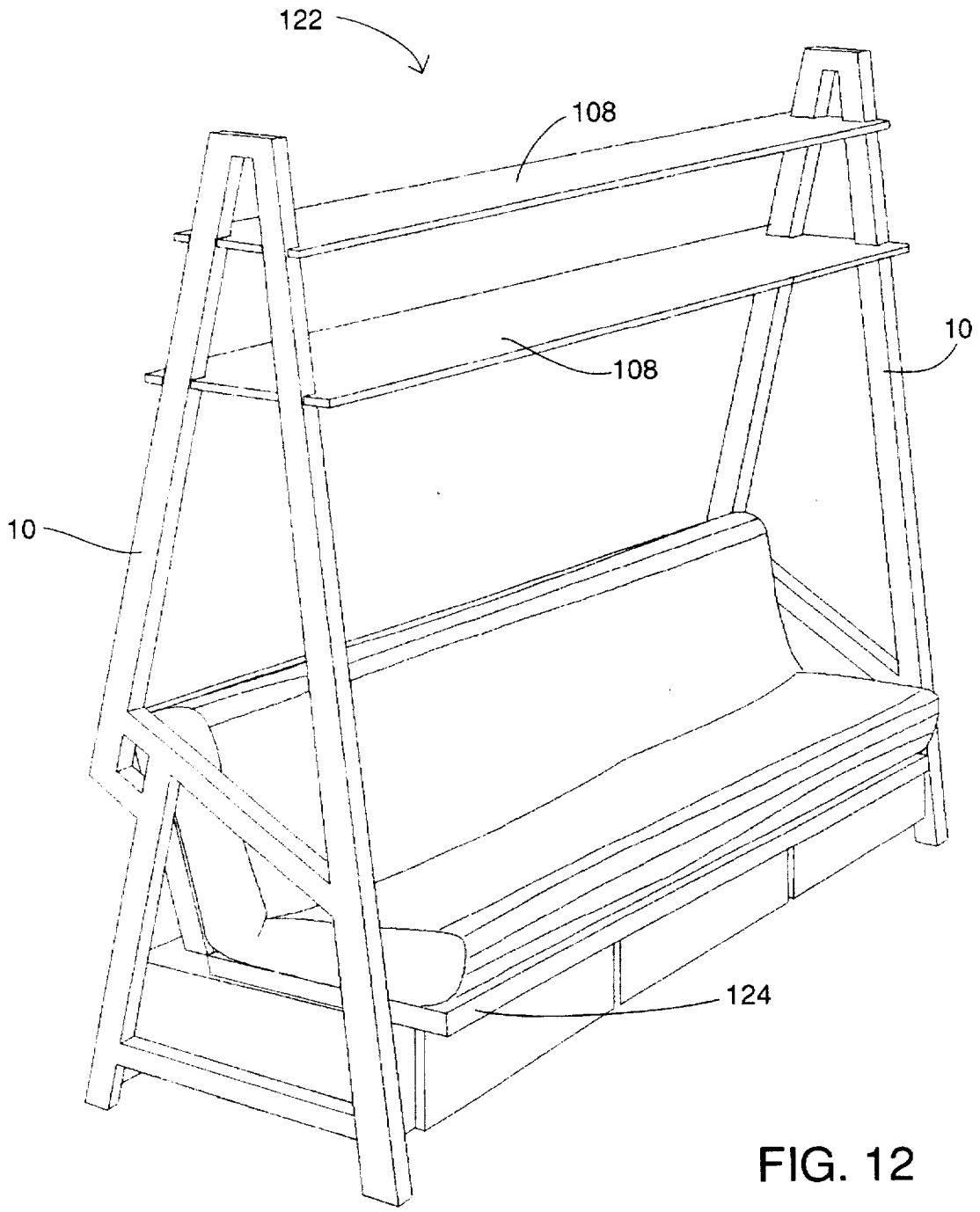
FIG. 12 is a side view of a futon that is made with a combination of frame assemblies, connecting assemblies and accessory assemblies in accordance with the present invention.

Referring next to FIG. 12 there is illustrated a futon or sofa assembly 122 which is constructed with a pair of A-frame assemblies 10, various connecting assemblies, and selected accessory assemblies including futon hardware 124, shelving units 108, drawer and door units, and the like.

Figure 13:
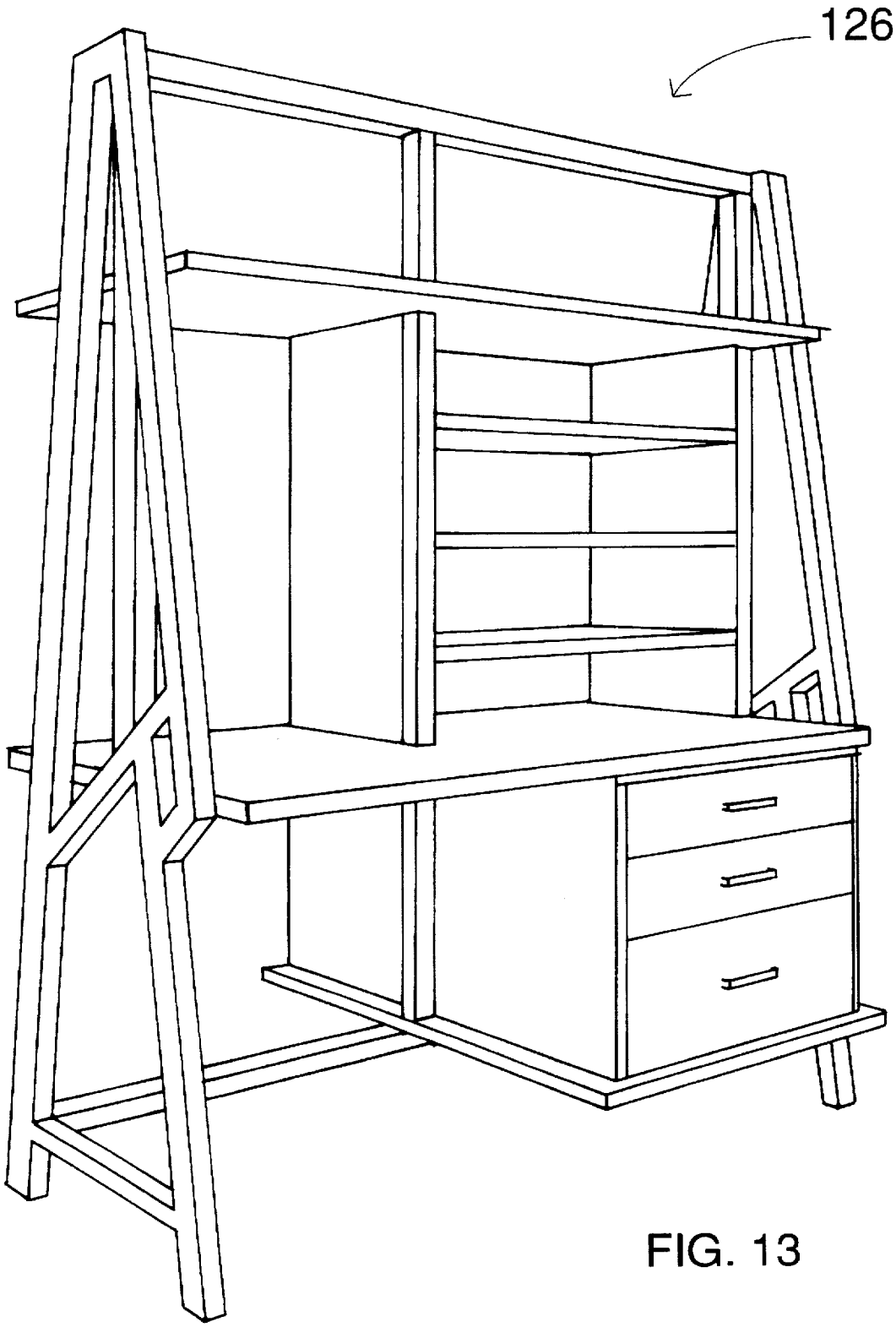
FIG. 13 is desk that is made with a combination of frame assemblies, connecting assemblies and accessory assemblies in accordance with the present invention.
Figure 14:
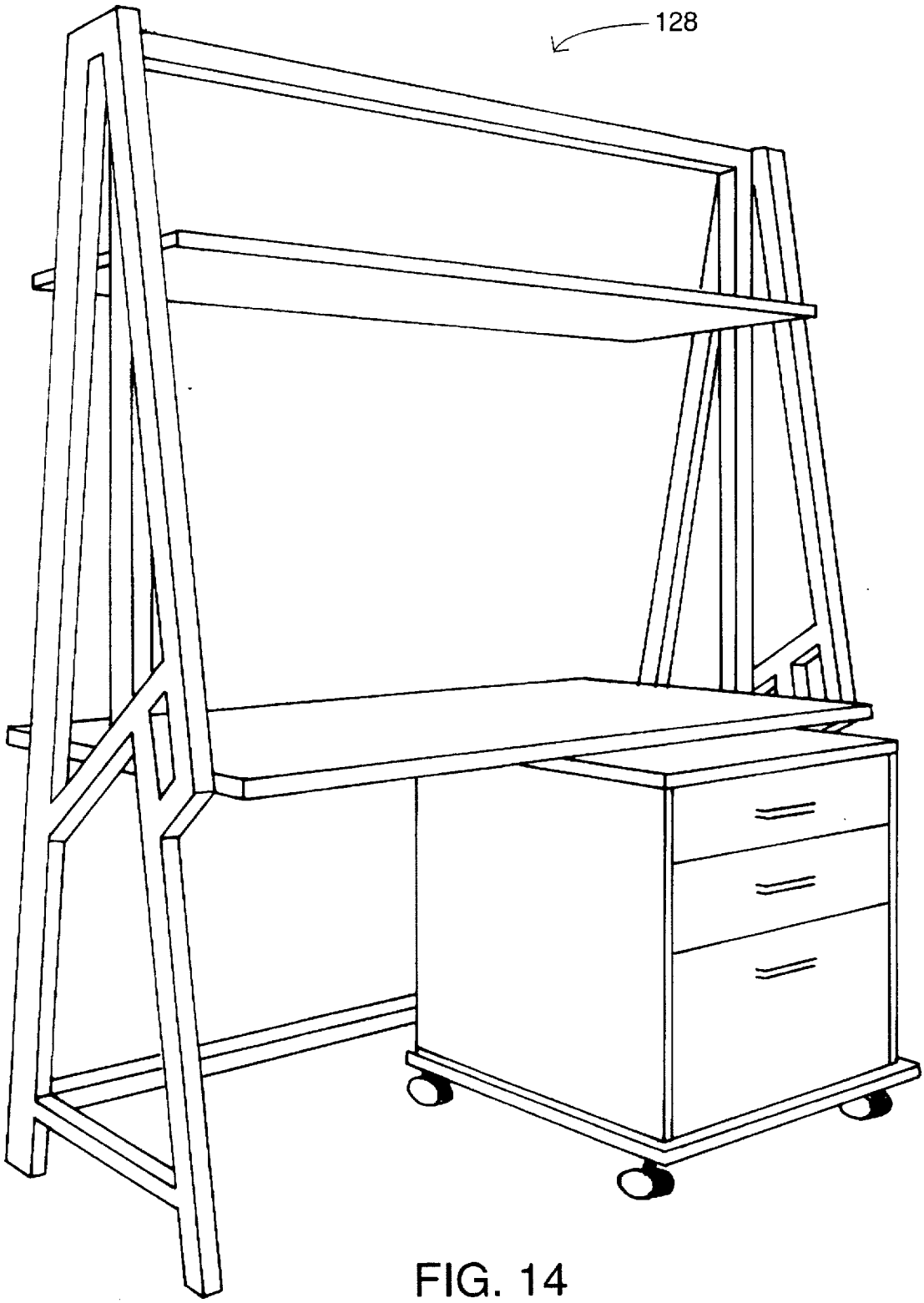
FIG. 14 is table that is made with a combination of frame assemblies, connecting assemblies and accessory assemblies in accordance with the present invention.
Figure 15:
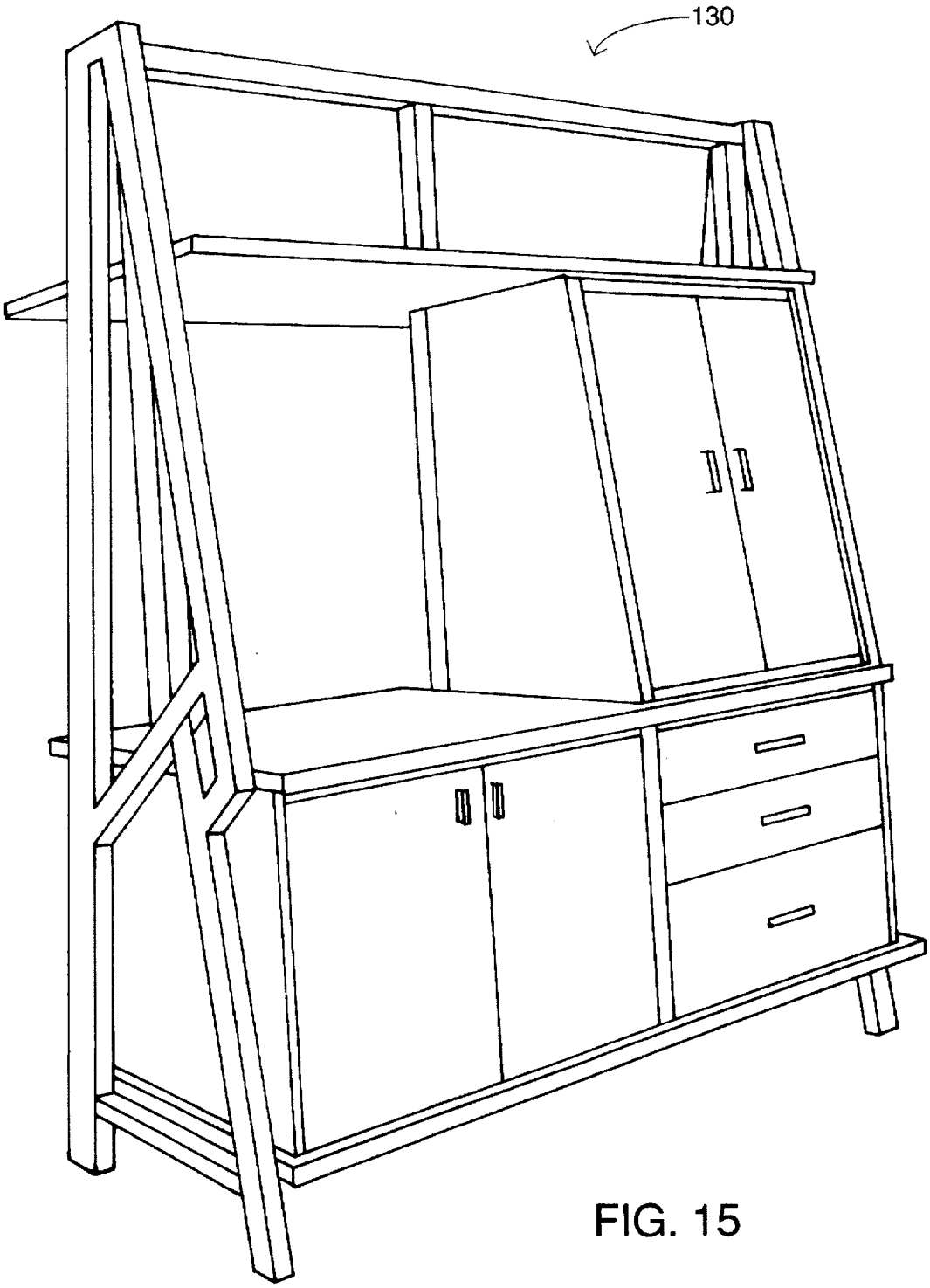
FIG. 15 is entertainment unit that is made with a combination of frame assemblies, connecting assemblies and accessory assemblies in accordance with the present invention.

FIGS. 13, 14 and 15 illustrate a desk 126, a table 128, and an entertainment unit 130, respectively. Each of these three furniture items utilize a combination of A-Frame assemblies, vertical support assemblies, top cross members, base cross members, shelving units, flat surfaces or support planks, a variety of different drawer units and other accessory assemblies.

Figure 16:
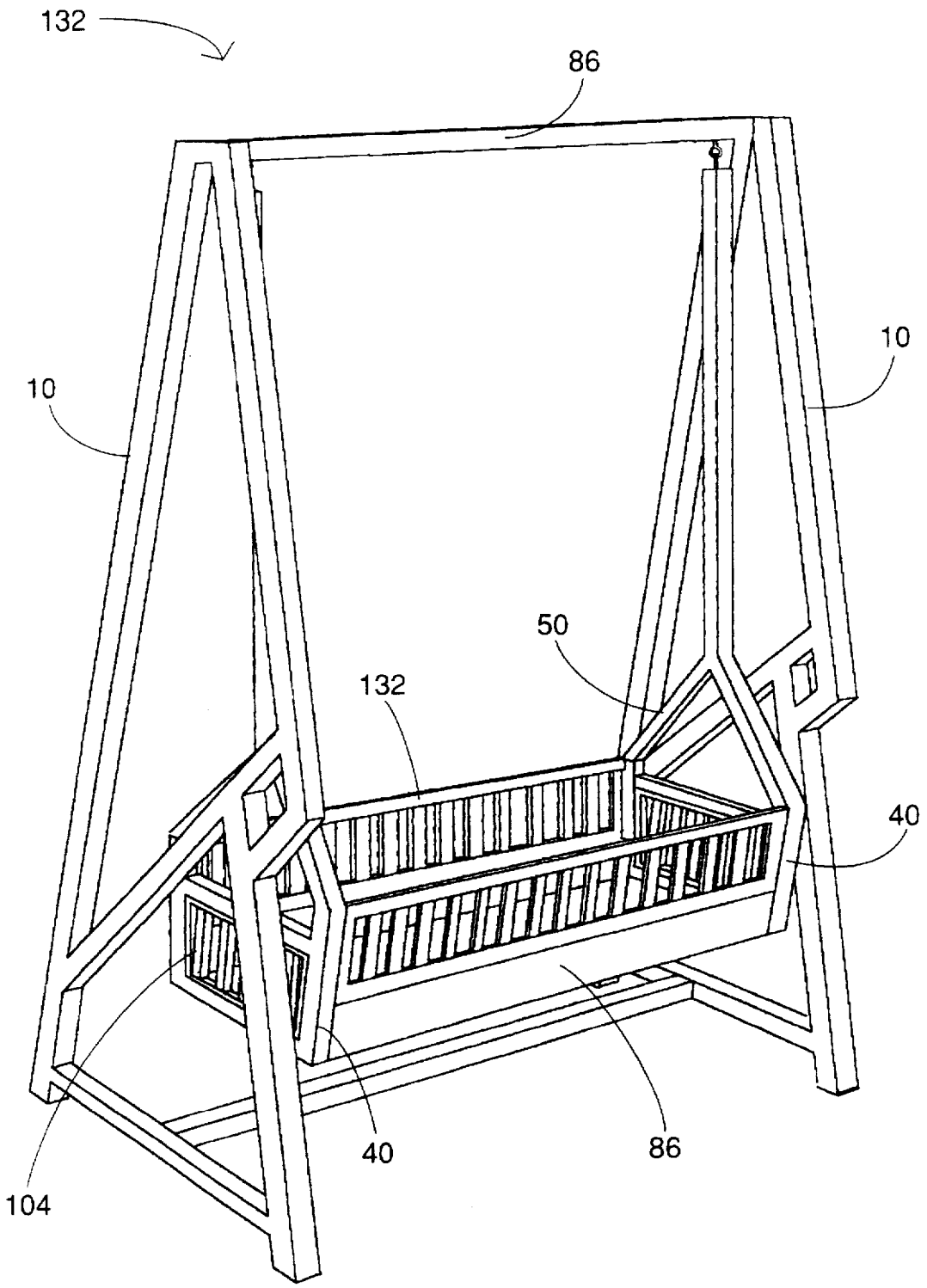
FIG. 16 is cradle that is made with a combination of frame assemblies, connecting assemblies and accessory assemblies in accordance with the present invention.

Referring next to FIG. 16 there is illustrated a cradle 132 which includes a combination of two A-frame assemblies 10, two trapezoidal frame assemblies 40, and two pedestal assemblies 50. The framing assemblies are connected using several support beams 86. The cradle further includes accessory items such as cradle hardware, interior slats 104 and safety rails.

Figure 17A:
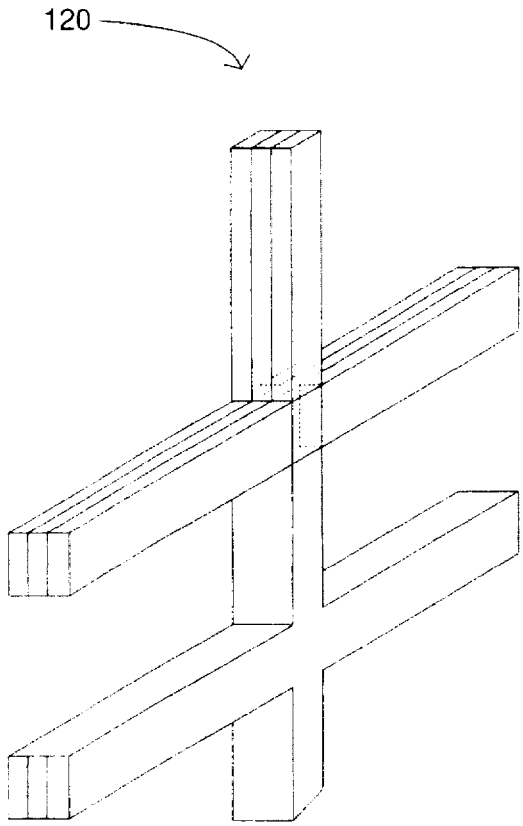
FIGS. 17*a* and 17*b* are views of several embodiments of a vertical support members or flying cross that is used in various furniture items in accordance with the present invention.
Figure 17B:
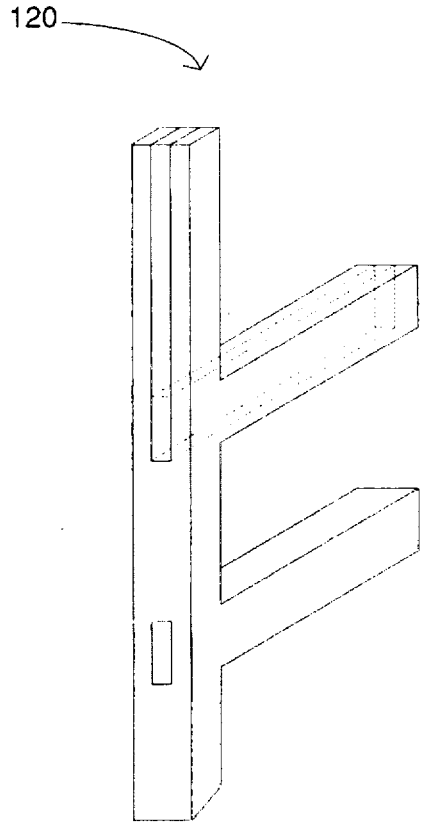

Finally, FIGS. 17*a* and 17*b* illustrate two embodiments of the vertical support 120 or flying cross which are used as a structural support in a variety of furniture items including the desk, tables, and entertainment unit.

From the foregoing, it should be appreciated that the present invention thus provides a system of modular transformable furniture that utilizes a combination of basic structural assemblies that easily transform into over one hundred different items of aesthetically pleasing furniture. While the invention herein disclosed has been described by means of specific embodiments and applications thereof, numerous modifications and variations could be made thereto by those skilled in the art without departing from the scope of the invention set forth in the claims or sacrificing all of its material advantages.

What is claimed is:

1. An A-frame assembly, comprising:

first and second lower vertices that are separated at the ground plane by a predetermined distance;

first and second upper vertices that intersect an apex formed at an upper horizontal cross member;

a lower cross member that connects together the lower vertices near the ground plane;

a long diagonal cross member that connects the first lower vertice to the first upper vertice such that the first lower vertice and the first upper vertice are aligned and that connects the second lower vertice to the second upper vertice such that the second lower vertice and the second upper vertice are disposed in a parallel orientation to each other and are offset from each other to form an A-frame shape; and short diagonal cross member oriented parallel to the long diagonal cross member and connecting the second lower vertice to the second upper vertice.

2. A modular transformable furniture system comprising:

frame means for providing structural support above a horizontal around plane, including:

first and second lower vertices that are separated at the ground plane by a predetermined distance;

first and second upper vertices that intersect at an apex formed at an upper horizontal cross member;

a lower cross member that connects together the lower vertices near the ground plane;

a long diagonal cross member that connects the first lower vertice to the first upper vertice such that the lower vertice and the first upper vertice are aligned and that connects the second lower vertice to the second upper vertice such that the second lower vertice and the second upper vertice are disposed in a parallel orientation to each other and are offset from each other to form an A-frame shape; and a short diagonal cross member oriented parallel to the long diagonal cross member and connecting the second lower vertice to the second upper vertices rail means for providing a horizontal support between the frame means; and connection means for connecting the rail means to the frame means.

3. A modular transformable furniture system as defined in claim 2, wherein the frame means comprises:

first and second angled vertices; and first and second parallel cross members that connect to the first and second angled vertices such that the frame means has a trapezoidal shape.

4. A modular transformable furniture system as defined in claim 2, wherein the connection means comprises a plurality of engagement structures, each structure including two L-shaped protrusions extending from a flat plate secured to the rail means and a support member including a flat receiving plate having two holes that removeably receive the L-shaped protrusions.

5. A modular transformable furniture system as defined in claim 2, wherein the connection means comprises a V-wedge connector including a flat V-wedge element attached to the rail means and a receiving element, attached to the frame means, having tapered edge channels that slidably receives the flat V-wedge element.

6. A modular transformable furniture system as defined in claim 2, wherein the connection mean comprises first, second, and third frame layers in the frame means, wherein the second layer has a void that received an insert of the rail means.

7. A modular transformable furniture system as defined in claim 2, wherein the rail means comprises four support beams such that the furniture system forms a bed frame.

8. A modular transformable furniture system as defined in claim 2, further comprising:

support planks connected to the frame means; and vertical supports connected between the rail means and the support planks such that the furniture system forms a desk.

9. A modular transformable furniture system as defined in claim 2, further comprising a cradle suspended from the rail means.

10. A modular transformable furniture system as defined in claim 9, further comprising pedestal frames having a base unit and a stem that suspends the cradle from the rail means.

* * * * *

UNITED STATES PATENT AND TRADEMARK OFFICE

CERTIFICATE OF CORRECTION

PATENT NO. : 5,754,995

DATED : May 26, 1998

INVENTOR(S) : Behrendt

It is certified that error appears in the above-indentified patent and that said Letters Patent is hereby corrected as shown below:

Claim 1, column 12, line 11, before "short", insert --a--. Claim 2, column 12, line 24, after the second occurrence of "the", insert --first--.

Signed and Sealed this

Twenty-fifth Day of August, 1998

Bruce Lehman

*Attest:*

BRUCE LEHMAN

*Attesting Officer*

*Commissioner of Patents and Trademarks*